US011337884B1

(12) United States Patent
Kovatch

(10) Patent No.: US 11,337,884 B1
(45) Date of Patent: May 24, 2022

(54) APPARATUS ALLOWING A USER TO MAKE LEAPING STRIDES WHILE WALKING OR RUNNING

(71) Applicant: David R. Kovatch, Florida, NY (US)

(72) Inventor: David R. Kovatch, Florida, NY (US)

( * ) Notice: Subject to any disclaimer, the term of this patent is extended or adjusted under 35 U.S.C. 154(b) by 65 days.

(21) Appl. No.: 16/949,852

(22) Filed: Nov. 17, 2020

(51) Int. Cl.
*A61H 3/04* (2006.01)

(52) U.S. Cl.
CPC ..... *A61H 3/04* (2013.01); *A61G 2203/10* (2013.01); *A61H 2201/1633* (2013.01); *A61H 2203/0406* (2013.01)

(58) Field of Classification Search
CPC . B62M 1/00; B62K 17/00; A61H 3/04; A61H 2201/1633
See application file for complete search history.

(56) References Cited

U.S. PATENT DOCUMENTS 2,752,162 A * 6/1956 Bowman ..... B62K 9/02 280/1.206
5,271,635 A * 12/1993 Lu ..... B62K 25/04 280/283
5,403,027 A * 4/1995 Hwang ..... B62K 3/04 280/278
6,102,420 A * 8/2000 Hoeksta ..... B62K 21/00 482/68
6,474,667 B1 * 11/2002 Stocksmeier ..... B62K 3/02 280/200
6,588,787 B2 * 7/2003 Ou ..... B62K 15/008 280/278
6,619,681 B2 9/2003 Gutierrez
7,341,543 B2 * 3/2008 Dandy ..... A63B 22/20 280/271
7,900,940 B1 * 3/2011 Vidmar ..... A61H 3/008 280/271
10,435,107 B2 * 10/2019 Dodds ..... B62L 3/04
2009/0194142 A1 * 8/2009 Zimmerman ..... A61H 3/04 135/67
2015/0076797 A1 * 3/2015 Alink ..... A61H 3/04 280/647
2018/0116898 A1 5/2018 Morbi et al.

FOREIGN PATENT DOCUMENTS

CN 101642404 B 8/2011
WO 20190191097 A1 10/2019

* cited by examiner

*Primary Examiner* — Noah Chandler Hawk
(74) *Attorney, Agent, or Firm* — Law Offices of Michael L. Wise, LLC

(57) ABSTRACT

An apparatus includes: a frame, a pivoting arm, a seat, and one or more biasing members. The frame includes a front wheel and a rear wheel, the front wheel being steerable. The pivoting arm pivotally attaches to the frame. The seat is attached to the pivoting arm. Lastly, the one or more biasing members span between the frame and the pivoting arm and influence the pivoting motion of the pivoting arm relative to the frame. In use, the apparatus is able to provide a user with a sense of weightlessness while the user travels forward by foot.

17 Claims, 7 Drawing Sheets

Fig. 9
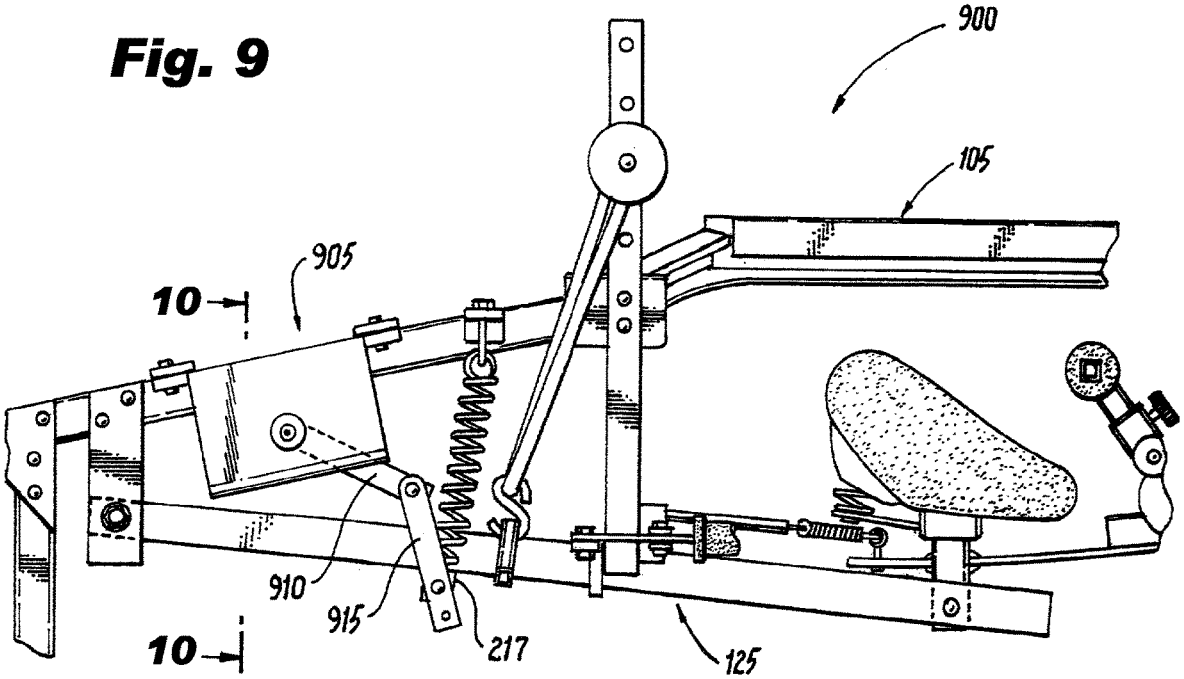
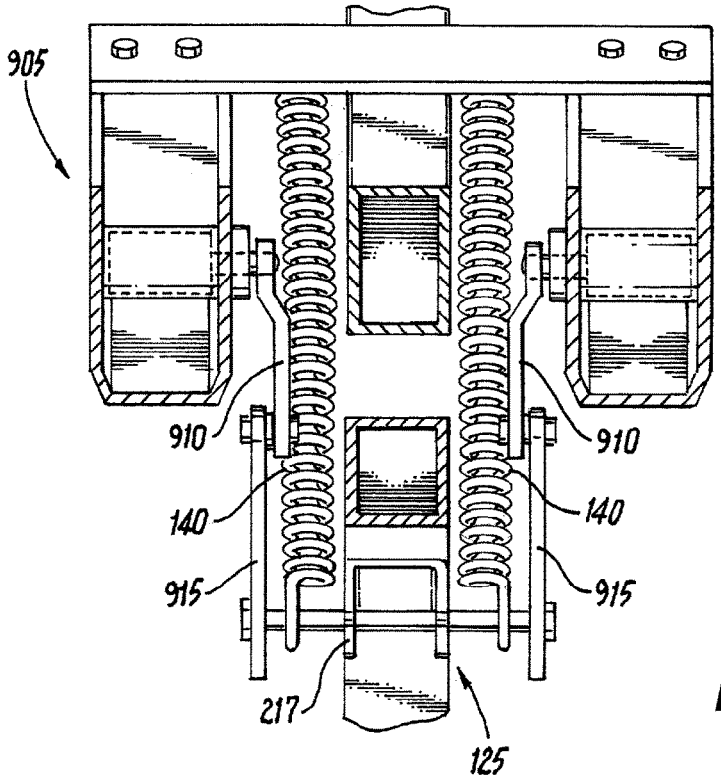
Fig. 10

APPARATUS ALLOWING A USER TO MAKE LEAPING STRIDES WHILE WALKING OR RUNNING

FIELD OF THE INVENTION

The present invention relates generally to apparatus for use by humans while walking or running, and, more particularly, to apparatus that enhance the ability of a human user to walk or run with leaping strides.

BACKGROUND OF THE INVENTION

Ever since astronauts were televised bounding across the surface of the moon in apparent weightlessness, many have sought a similar experience closer to Earth. Some, for example, have booked trips on the famous "Vomit Comet," an aircraft that gives its occupants the sensation of weightlessness by following a parabolic flight path relative to the center of the Earth. While following this path, the aircraft and its payload are in free fall at certain points of its flight path. During this time, the aircraft does not exert any ground reaction force on its contents, causing the sensation of weightlessness.

There is, however, no ready, safe, and economical way to create this same sense of weightlessness for the average human on the ground. As a result, there is a need for such an apparatus.

SUMMARY OF THE INVENTION

Embodiments of the present invention address the above-identified need by providing an apparatus that may be used to allow a user to make leaping strides while walking or running.

Aspects of the invention are directed to an apparatus comprising: a frame, a pivoting arm, a seat, and one or more biasing members. The frame comprises a front wheel and a rear wheel, the front wheel being steerable. The pivoting arm pivotally attaches to the frame. The seat is attached to the pivoting arm. Lastly, the one or more biasing members span between the frame and the pivoting arm and influence the pivoting motion of the pivoting arm relative to the frame.

BRIEF DESCRIPTION OF THE DRAWINGS

These and other features, aspects, and advantages of the present invention will become better understood with regard to the following description, appended claims, and accompanying drawings where:

FIG. 9 shows a side elevational view of a rear portion of an apparatus in accordance with an alternative embodiment of the invention; and FIG. 10 shows a sectional view of the FIG. 9 apparatus.

DETAILED OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Directional terms used herein and in the appended claims are referenced to an apparatus configured with its front wheel and rear wheel resting on a horizontal surface with the apparatus in an upright, rolling configuration. The forward direction is the direction from the rear wheel towards the front wheel. The upward direction is the direction above and away from the horizontal surface. The remainder of the directions (e.g., rearward, leftward, rightward, downward, vertical) are referenced to the forward and upward directions. The leftward and rightward directions each describe what will also be called a lateral direction.

Embodiments of the invention include apparatus that may be used by human riders to gain a sense of weightlessness while traveling forward on foot. More particularly, these apparatus allow a user to make leaping strides while walking or running (i.e., they allow the user to bound). Such apparatus may have a myriad of uses; they may be suitable for anything from training astronauts to providing forms of amusement.

Figure 1:
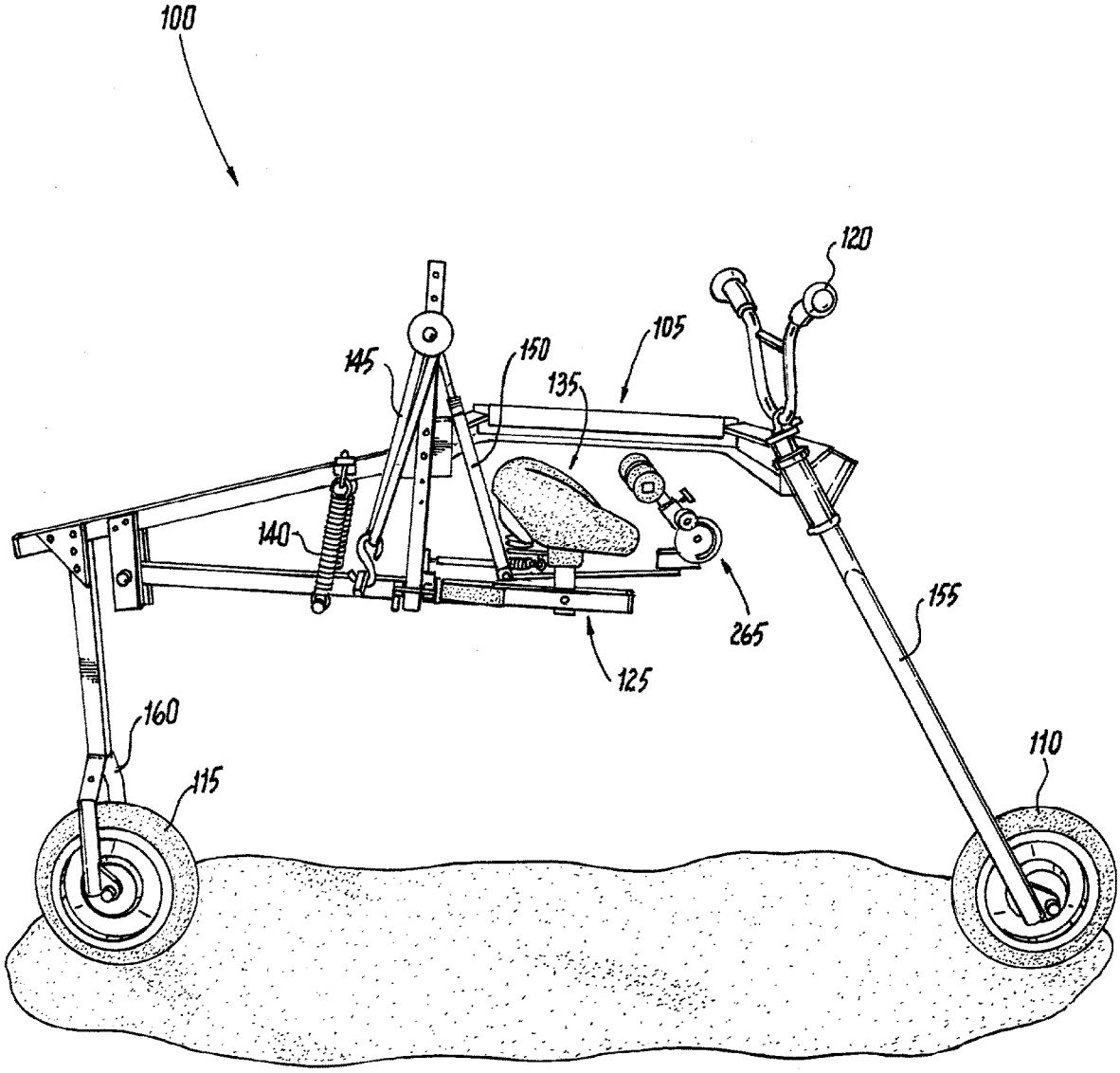
FIG. 1 shows a side perspective view of an apparatus in accordance with an illustrative embodiment of the invention.

FIG. 1 shows a side perspective view of an apparatus 100 in accordance with an illustrative embodiment of the invention. The apparatus 100 includes a frame 105 having a front wheel 110 and a rear wheel 115. The front wheel 110 is steerable via a set of handlebars 120. A pivoting arm 125 is pivotally attached to the rearward portion of the frame 105 and projects forward therefrom. A seat 135 is pivotally attached to the frontal portion of the pivoting arm 125. A pair of springs 140, a pair of elastic bands 145, and a damper 150 span between the frame 105 and the pivoting arm 125. The pair of springs 140, the pair of elastic bands 145, and the damper 150 influence the pivoting motion of the pivoting arm 125 relative to the frame 105.

Accordingly, the exemplary apparatus 100 includes the frame 105 with the front wheel 110 and the rear wheel 115, the front wheel 110 being steerable. The pivoting arm 125 pivotally attaches to the frame 105. The seat 135 pivotally attaches to the pivoting arm 125. Biasing members (i.e., the pair of springs 140, the pair of elastic bands 145, and the damper 150) span between the frame 105 and the pivoting arm 125 and influence the pivoting motion of the pivoting arm 125 relative to the frame 105. The biasing members 140, 145, 150 attach to the pivoting arm 125 between where the pivoting arm 125 attaches to the frame 105 and where the seat 135 attaches to the pivoting arm 125.

Figure 2:
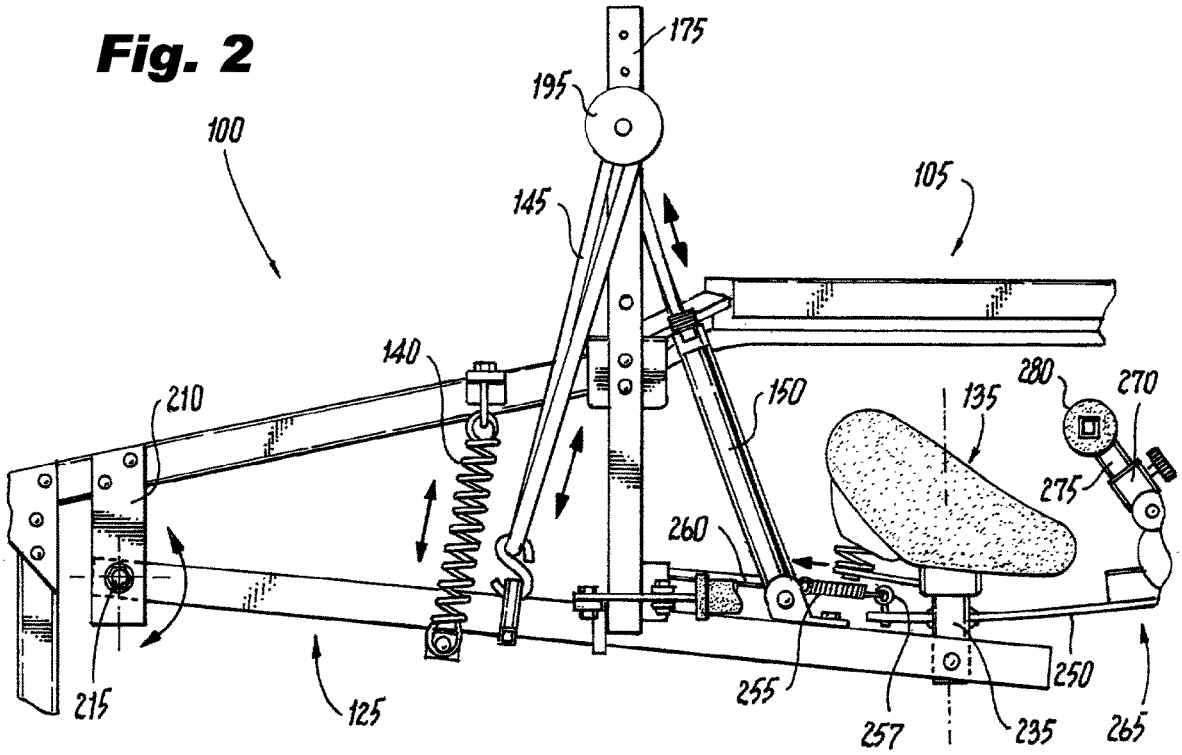
FIG. 2 shows a side elevational view of a rear portion of the FIG. 1 apparatus.
Figure 3:
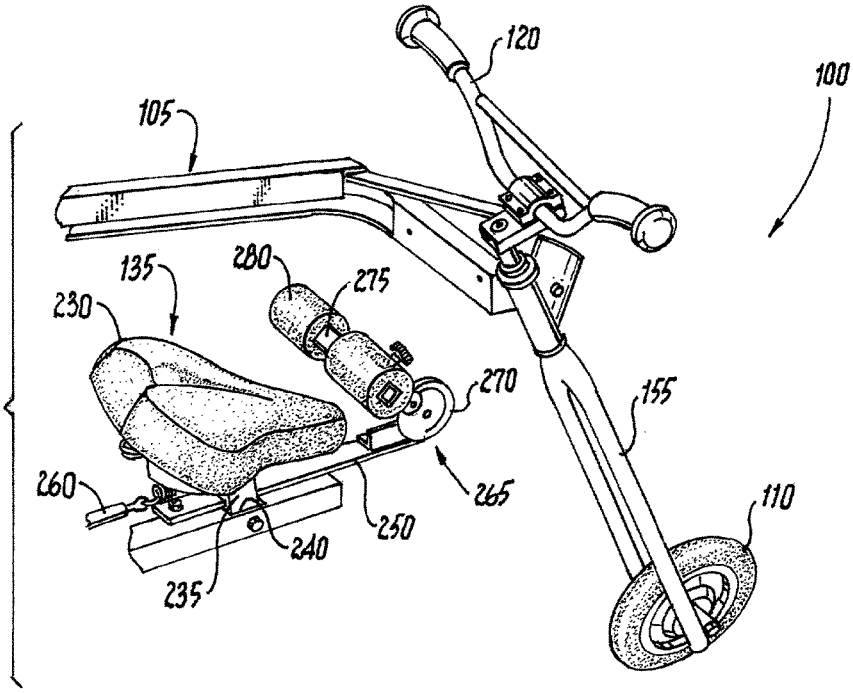
FIG. 3 shows a side perspective view of a front portion of the FIG. 1 apparatus.
Figure 4:
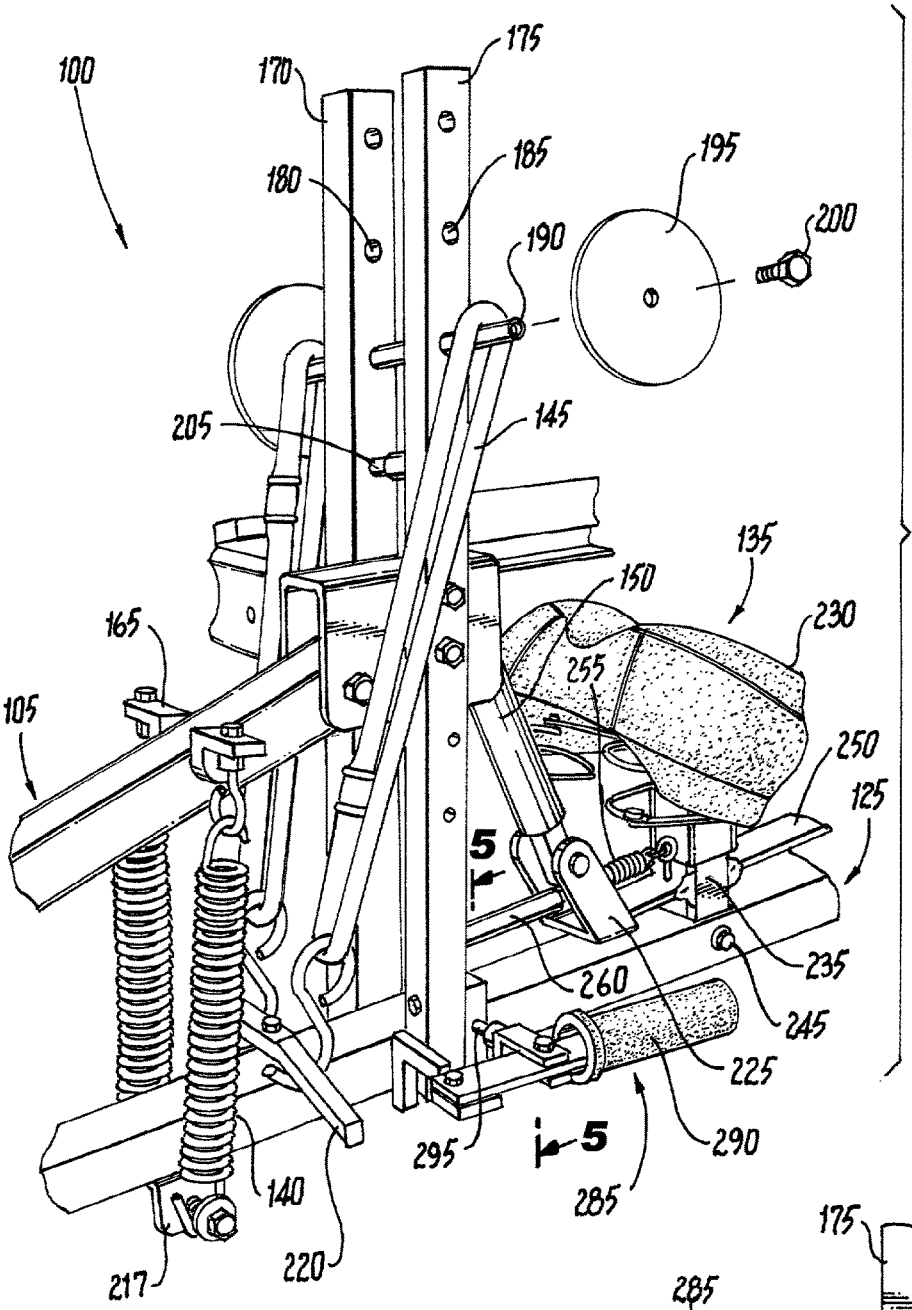
FIG. 4 shows a side, partially exploded, perspective view of a middle portion of the FIG. 1 apparatus.

FIGS. 2-4 show additional details of the apparatus 100, with: FIG. 2 showing a side elevational view of a rear portion of the apparatus 100; FIG. 3 showing a side perspective view of a front portion of the apparatus 100; and FIG. 4 showing a side, partially exploded, perspective view of a middle portion of the apparatus 100.

The frame 105 includes a front fork 155 that supports the front wheel 110 and is rotationally coupled to the set of handlebars 120 to allow the set of handlebars 120 to steer the apparatus 100 via the front wheel 110. A rear fork 160 supports the rear wheel 115. While a rearward portion of the frame 105 is disposed directly in line between the front wheel 110 and the rear wheel 115, another portion of the frame 105 passes lateral to the seat 135 so that the frame 105 does not interfere with the pivoting arm 125 and the seat 135. The apparatus 100 is therefore non-symmetric when viewed top down.

The frame 105 further comprises a number of accessory elements that facilitate the coupling of the biasing members 140, 145, 150 to the frame 105. The frame 105 comprises a pair of upper spring-attachment brackets 165. Moreover, the frame 105 further includes a left upright post 170 and a right upright post 175, with the right upright post 175 being in spaced relation to the left upright post 170. The left upright post 170 defines a series of left holes 180 passing therethrough, while the right upright post 175 defines a series of right holes 185 passing therethrough. The left holes 180 are indexed with the right holes 185. A height-adjustable rod 190 passes through matching right and left holes 180, 185. Two annular disks 195 are positioned on opposed ends of the height-adjustable rod 190 and are fixed with rod bolts 200. A damper-attachment pin 205 also spans between the left upright post 170 and the right upright post 175.

To facilitate attachment of the pivoting arm 125 to the frame 105, two downward oriented plates with a pair of mutually aligned holes form a pivoting arm bracket 210 for the frame 105. A pivoting arm bolt 215 passes through theses mutually aligned holes and through a hole in the pivoting arm 125 to pivotally attach the pivoting arm 125 to the frame 105. A bearing may be placed within the hole in the pivoting arm 125 so that the bearing pivotally attaches the pivoting arm 125 to the frame 105 to aid in providing smooth pivoting motion to the pivoting arm 125.

The pivoting arm 125 is mostly square tubular. To aid with coupling the pivoting arm 125 to the biasing members 140, 145, 150, the pivoting arm 125 also comprises several attachment elements, namely, lower spring-attachment brackets 217, band-attachment hooks 220, and a damper-attachment bracket 225. The pivoting arm 125 may pivot relative to the frame 105 so as to describe a range of motion. At least some of this range of motion lies directly between the left upright post 170 and the right upright post 175.

The seat 135 comprises a bicycle-style cushion 230 that is mounted atop a seat post 235. The bottom portion of the seat post 235 is disposed in a slot 240 in the pivoting arm 125, where it is held in place by a seat bolt 245 that passes horizontally through holes in the pivoting arm 125 and a hole in the seat post 235 so that the seat 135 is pivotally attached to the pivoting arm 125. A seat arm 250 is fixated to the seat post 235 by a weld so that a portion of the seat arm 250 projects rearward of the seat post 235 and another portion of the seat arm 250 projects forward of the seat post 235.

A seat spring 255 is attached to the anterior portion of the seat arm 250 via an eyebolt 257. The seat spring 255, in turn, is attached to a turnbuckle 260, which attaches to the pivoting arm 125. The combination of the seat spring 255 and the turnbuckle 260 urge the seat 135 to pivot in the rearward direction so that the seat spring 255 influences the pivoting motion of the seat 135 relative to the pivoting arm 125. Adjustment of the turnbuckle 260 allows the extent of the rearward bias to be manually adjusted.

A restraint assembly 265 is attached to the seat arm 250 forward of the seat 135. The restraint assembly 265 comprises: a position-adjustment bracket 270, a T-shaped bar 275, and two cylindrical cushions 280. The position-adjustment bracket 270 is disposed at the end of the seat arm 250 and provides a sleeve in which the long leg of the T-shaped bar 275 is disposed. The position-adjustment bracket 270 provides both a means of rotating the T-shaped bar 275 about a lateral axis (in a manner similar to a conventional miter gauge) as well as a means of setting the extent to which the T-shaped bar 275 extends from the position-adjustment bracket 270. The position of the T-shaped bar 275 may therefore be precisely placed in relation to the seat 135. Each of the two cylindrical cushions 280 cover a respective short leg of the T-shaped bar 275. The T-shaped bar 275 and the two cylindrical cushions 280 are thereby mounted to the pivoting arm 125 and are coupled to the pivoting motion of the seat 135 relative to the frame 105.

In the present illustrative embodiment, the pair of springs 140, the pair of elastic bands 145, and the damper 150 form the biasing members that span between the frame 105 and the pivoting arm 125 and influence the pivoting motion of the pivoting arm 125 relative to the frame 105. Alternative embodiments may, however, include a different grouping of biasing members and still come within the scope of the invention. Additionally or alternatively, other suitable means of bias may be utilized such as hydraulic, pneumatic, or electric actuators.

Returning to the apparatus 100, the pair of springs 140 span between the lower spring-attachment brackets 217 on the pivoting arm 125 and the upper spring-attachment brackets 165 on the frame 105. The pair of elastic bands 145 span between the band-attachment hooks 220 on the pivoting arm 125 and the height-adjustable rod 190, where they are restricted from slipping off by the two annular disks 195. Adjustment of the height of the height-adjustable rod 190 on the upright posts 170, 175 thereby influences the forces that the pair of elastic bands 145 place on the pivoting arm 125. Finally, the damper 150 spans between the damper-attachment bracket 225 on the pivoting arm 125 and the damper-attachment pin 205 on the frame 105. The damper 150 is pivotally attached to the damper-attachment bracket 225 and the damper-attachment pin 205, allowing the damper 150 to change orientation as the pivoting arm 125 pivots up and down relative to the frame 105.

In the present illustrative embodiment, the damper 150 comprises a conventional tube-like damper or shock absorber. Inside the damper 150, a piston is attached to the end of a piston rod and works against hydraulic fluid in a pressure tube. As the pivoting arm 125 travels up and down, the hydraulic fluid is forced through orifices inside the piston. Because the orifices only allow a small amount of fluid through the piston, the piston is slowed which in turn retards or dampens the pivoting motion of the pivoting arm 125 relative to the frame 105. Alternative embodiments may utilize a pneumatic damper rather than a hydraulic damper.

A locking assembly 285 forms a final portion of the apparatus 100 and allows the user to lock the pivoting arm 125 so that it can no longer pivot relative to the frame 105. The ability to lock the pivoting arm 125 is convenient when the user is, for example, getting on or getting off the apparatus 100, storing the apparatus 100, or making adjustments to the apparatus 100.

Figure 5:
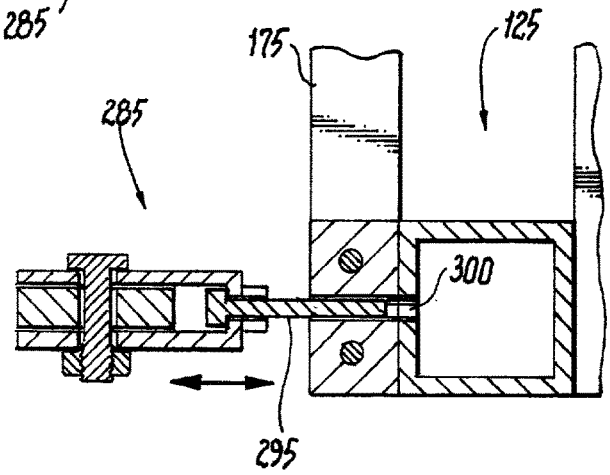
FIG. 5 shows a sectional view of a locking assembly in the FIG. 1 apparatus.

FIG. 5 shows a sectional view of the locking assembly 285 along the cleave plane indicated in FIG. 4. The locking assembly 285 includes a pivoting handle 290 that is pivotally attached to the right upright post 175 of the frame 105 in such a way that the pivoting handle 290 can pivot around a vertical axis. A locking pin 295 is attached to the pivoting handle 290 and moves with the pivoting handle 290. When a locking hole 300 in the pivoting arm 125 is in line with the locking pin 295, movement of the pivoting handle 290 is able to insert the locking pin 295 into the locking hole 300, or to retract the locking pin 295 from the locking hole 300 once so placed. With the locking pin 295 inserted into the locking hole 300, the pivoting arm 125 is restricted from moving relative to the frame 105. While the pivoting handle 290 is attached to the right upright post 175 in the apparatus 100, alternative embodiments could have the pivoting handle 290 instead attached to the left upright post 170 or to some other portion of the frame 105.

Figure 6:
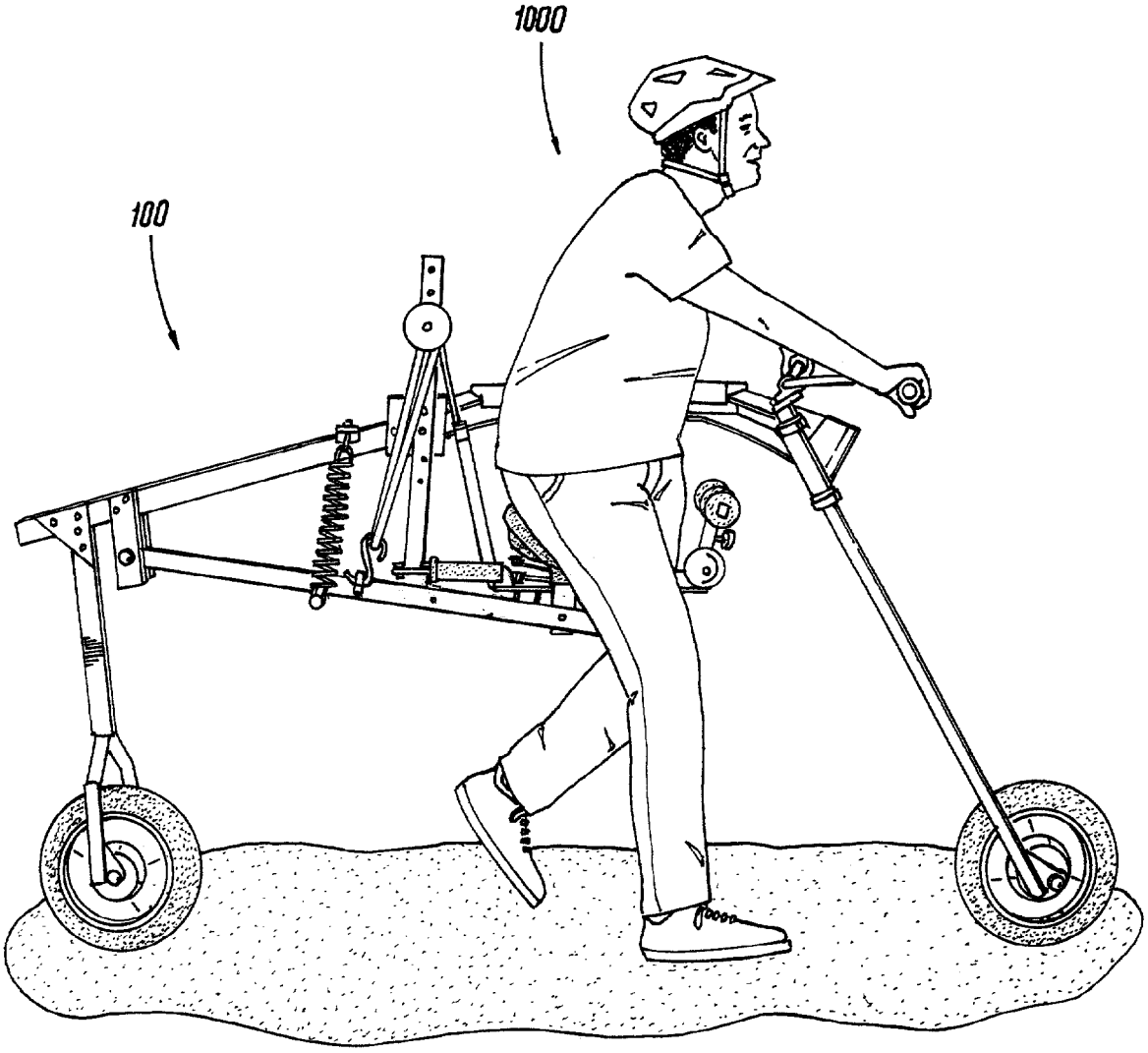
FIGS. 6-8 show a sequence of side perspective views of a user using the FIG. 1 apparatus to bound.
Figure 7:
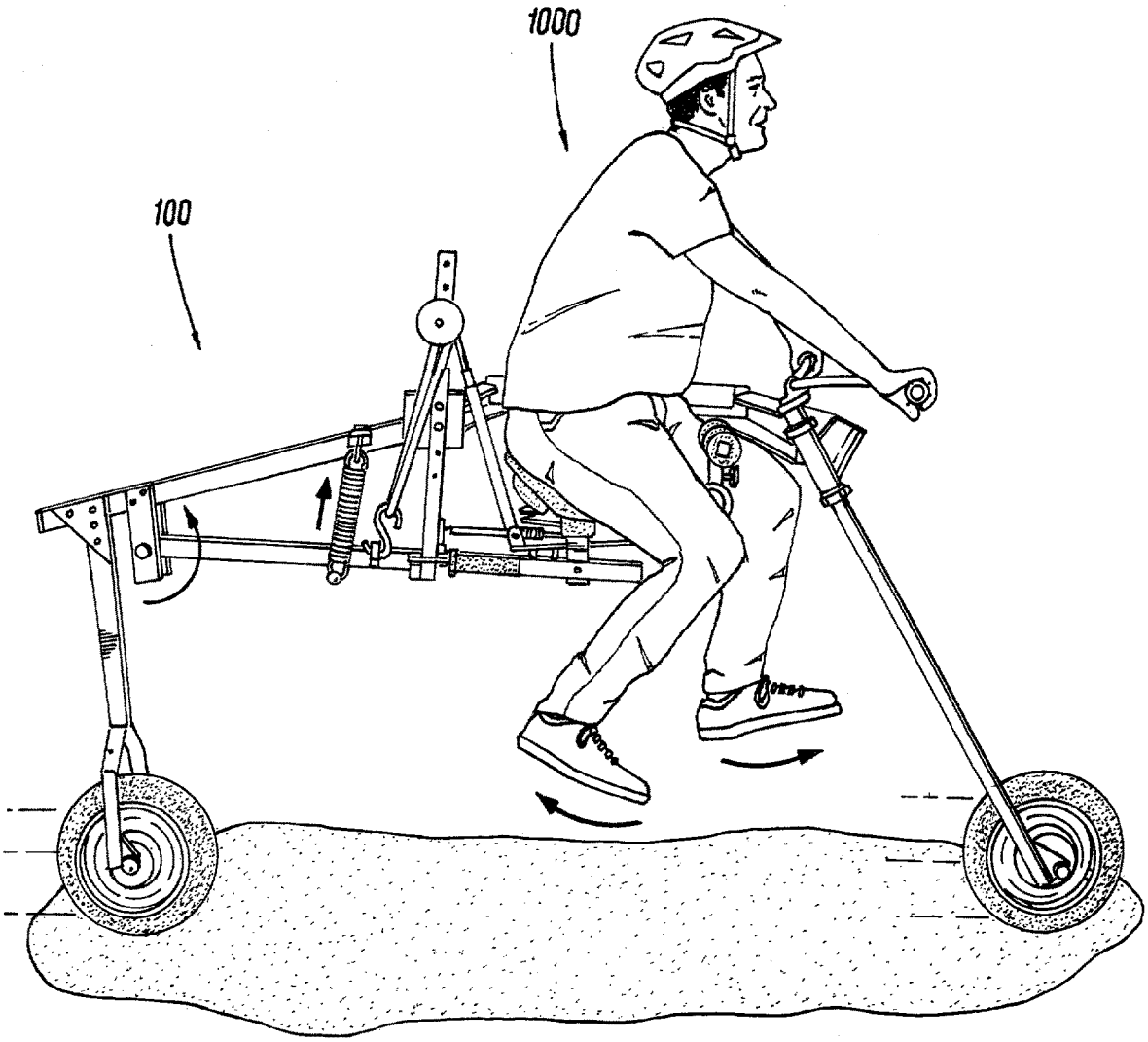
Figure 8:
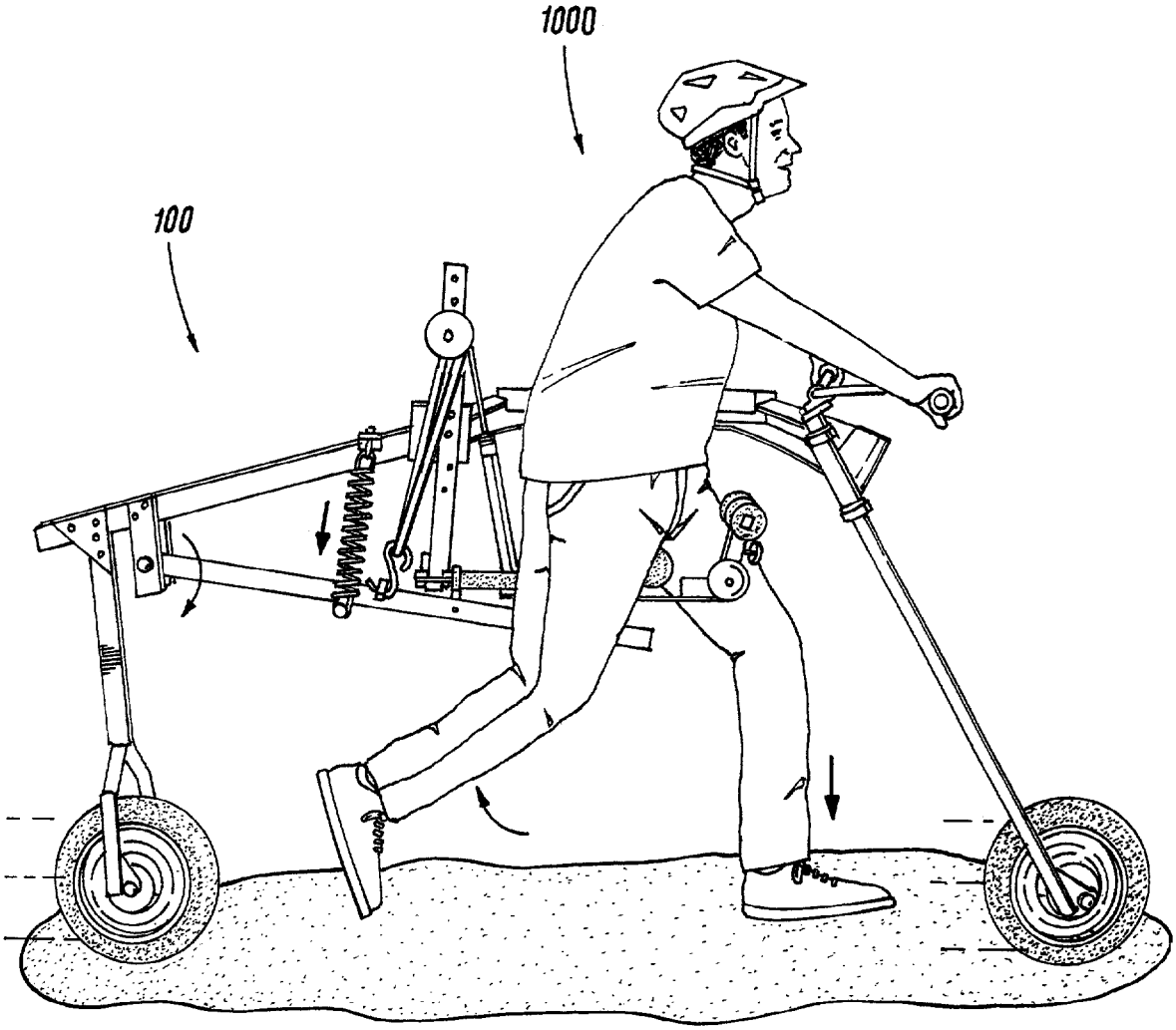

As indicated earlier, the apparatus 100 allows a user to make leaping strides while walking or running (i.e., they allow the user to bound). FIGS. 6-8 show a sequence of side perspective views of a user 1000 using the apparatus 100 in this manner. In using the apparatus 100, the user sits on the seat 135 and positions the restraint assembly 265 so that the two cylindrical cushions 280 are alternately pressed against the user's thighs as the user 1000 walks or runs, helping to hold the user securely in the apparatus 100. As the user 1000 travels forward, the pair of springs 140 and the pair of elastic bands 145 urge the pivoting arm 125 upward, while, at the same time, the damper 150 slows both the upward and downward travel of the pivoting arm 125. During use, the seat 135 is also able to stay substantially upright due to its ability to pivot relative to the pivoting arm 125. The user steers the apparatus 100 via the set of handlebars 120. In this manner, the biasing members 140, 145, 150 influence the pivoting motion of the pivoting arm 125 in such a manner as to provide the user 1000 with a sense of weightlessness. The apparatus 100 thereby provides the user 1000 with an experience that is not easily achieved on the ground.

Once understood from the description provided herein, the apparatus 100 may be formed using construction techniques that will already be familiar to one having ordinary skills in the relevant arts. Pertinent construction techniques are also provided in a number of readily available references including, for example, T. Lipton, *Metalworking Sink or Swim: Tips and Tricks for Machinists, Welders, and Fabricators*, Industrial Press, 2008, which is hereby incorporated by reference herein. Many of the components of the apparatus 100 are also commercially available.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art. The spirit and scope of the appended claims should not be limited solely to the description of the preferred embodiments contained herein.

For example, while the apparatus 100 utilizes the tube-like damper 150, alternative embodiments may utilize a different damper arrangement. FIG. 9 shows a side elevational view of a rear portion of an apparatus 900 in accordance with an alternative embodiment of the invention, while FIG. 10 shows a sectional view of the alternative apparatus 900 along the cleave plane indicated in FIG. 9. The alternative apparatus 900 utilizes many components identical to those in the apparatus 100, which are labeled with like reference numerals. However, instead of using the damper 150, the alternative apparatus 900 utilizes a pair of pneumatic door openers 905, which are attached to a rearward portion of the frame 105 to dampen the pivoting motion of the pivoting arm 125 relative to the frame 105. Each of the pair of pneumatic door openers 905 utilize a first arm 910 and a second arm 915 to couple to the pivoting arm 125. In the alternative apparatus 900, the second arms 915 are pivotally attached to the lower spring-attachment brackets 217 on the pivoting arm 125.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus comprising:

a frame comprising a front wheel and a rear wheel, the front wheel being steerable;

a pivoting arm pivotally attached to the frame;

a seat attached to the pivoting arm; and a plurality of biasing members spanning between the frame and the pivoting arm and influencing pivoting motion of the pivoting arm relative to the frame, the plurality of biasing members comprising a spring and a damper;

wherein the frame is continuous between the front wheel and the rear wheel and no portion of the frame is disposed directly below the seat.

2. The apparatus of claim 1, wherein a portion of the frame passes lateral to the seat.

3. The apparatus of claim 1, wherein the frame further comprises a set of handlebars operative to steer the front wheel.

4. The apparatus of claim 1, wherein the frame further comprises a front fork supporting the front wheel.

5. The apparatus of claim 1, wherein the frame further comprises a rear fork supporting the rear wheel.

6. The apparatus of claim 1, wherein the frame further comprises a bearing pivotally attaching the pivoting arm to the frame.

7. The apparatus of claim 1, wherein the seat is pivotally attached to the pivoting arm.

8. The apparatus of claim 1, further comprising a seat spring attached to the seat and influencing pivoting motion of the seat relative to the pivoting arm.

9. The apparatus of claim 1, further comprising a cylindrical cushion mounted to the pivoting arm and coupled to pivoting motion of the seat relative to the pivoting arm.

10. The apparatus of claim 1, wherein at least one of the plurality of biasing members attaches to the pivoting arm between where the pivoting arm attaches to the frame and where the seat attaches to the pivoting arm.

11. The apparatus of claim 1, wherein the plurality of biasing members comprise an elastic band.

12. The apparatus of claim 1, further comprising:

a pivoting handle pivotally attached to the frame; and a locking pin attached to the pivoting handle;

wherein the pivoting arm describes a locking hole and the locking pin is translatable into the locking hole by pivoting the pivoting handle with the pivoting arm positioned so that the locking hole is in line with the locking pin.

13. An apparatus comprising:

a frame comprising a front wheel and a rear wheel, the front wheel being steerable;

a pivoting arm pivotally attached to the frame;

a seat attached to the pivoting arm; and one or more biasing members spanning between the frame and the pivoting arm and influencing pivoting motion of the pivoting arm relative to the frame;

wherein the one or more biasing members comprise a spring, an elastic band, and a damper.

14. An apparatus comprising:

a frame comprising a front wheel and a rear wheel, the front wheel being steerable;

a pivoting arm pivotally attached to the frame;

a seat attached to the pivoting arm; and one or more biasing members spanning between the frame and the pivoting arm and influencing pivoting motion of the pivoting arm relative to the frame;

wherein the frame further comprises:

a left upright post defining a plurality of left holes passing therethrough; and a right upright post in spaced relation to the left upright post and defining a plurality of right holes passing therethrough.

15. The apparatus of claim 14, wherein the frame further comprises a height-adjustable rod passing through one of the plurality of left holes and one of the plurality of right holes.

16. The apparatus of claim 15, wherein the one or more biasing members comprise an elastic band that passes over the height-adjustable rod.

17. The apparatus of claim 14, wherein the pivoting arm describes a range of motion, at least some of which lies between the left upright post and the right upright post.

* * * * *